US007436370B2

(12) United States Patent
Blanton

(10) Patent No.: US 7,436,370 B2
(45) Date of Patent: Oct. 14, 2008

(54) DEVICE AND METHOD FOR POLARIZATION CONTROL FOR A PHASED ARRAY ANTENNA

(75) Inventor: James L. Blanton, Temecula, CA (US)

(73) Assignee: L-3 Communications Titan Corporation, San Diego, CA (US)

( * ) Notice: Subject to any disclaimer, the term of this patent is extended or adjusted under 35 U.S.C. 154(b) by 0 days.

(21) Appl. No.: 11/580,574

(22) Filed: Oct. 12, 2006

(65) Prior Publication Data

US 2008/0218424 A1 Sep. 11, 2008

Related U.S. Application Data

(60) Provisional application No. 60/727,051, filed on Oct. 14, 2005.

(51) Int. Cl.
*H01Q 19/00* (2006.01)

(52) U.S. Cl. ..... 343/756; 343/853; 342/359

(58) Field of Classification Search ..... 343/756, 343/853, 757, 766; 342/359
See application file for complete search history.

(56) References Cited

U.S. PATENT DOCUMENTS

| | | | | |
|---|---|---|---|---|
| 3,646,558 | A | 2/1972 | Campanella | |
| 4,028,702 | A | 6/1977 | Levine | |
| 4,277,787 | A | 7/1981 | King | |
| 4,445,119 | A | 4/1984 | Works | |
| 4,737,796 | A | 4/1988 | Bonebright et al. | |
| 5,117,239 | A | 5/1992 | Riza | |
| 5,151,814 | A | 9/1992 | Grinberg et al. | |
| 5,333,000 | A | 7/1994 | Hietala et al. | |
| 5,539,413 | A | 7/1996 | Farrell et al. | |
| 6,057,802 | A | 5/2000 | Nealy et al. | |
| 6,075,484 | A | 6/2000 | Daniel et al. | |
| 6,111,542 | A | 8/2000 | Day et al. | |
| 6,169,513 | B1 | 1/2001 | Cohen | |
| 6,175,332 | B1 | 1/2001 | Fedors | |
| 6,175,723 | B1 | 1/2001 | Rothwell, III | |
| 6,275,187 | B1 | 8/2001 | Ross et al. | |
| 6,563,471 | B2 * | 5/2003 | Spirtus | 343/757 |
| 6,611,230 | B2 | 8/2003 | Phelan | |
| 6,771,216 | B2 | 8/2004 | Patel et al. | |
| 2002/0036586 | A1 | 3/2002 | Gothard et al. | |
| 2003/0162566 | A1 * | 8/2003 | Shapira et al. | 455/561 |
| 2004/0108963 | A1 * | 6/2004 | Clymer et al. | 343/837 |
| 2006/0071876 | A1 * | 4/2006 | Clymer et al. | 343/911 R |

* cited by examiner

*Primary Examiner*—Tho G Phan
(74) *Attorney, Agent, or Firm*—Donn K. Harms

(57) ABSTRACT

A method of configuring a phased array antenna having a plurality of radiators, each said radiator elements capable of radiating or receiving signals in one of two orthogonal polarizations determined to achieve a pseudo-random mix of horizontally and vertically polarized radiators. Upon switching of each of the radiator elements to a calculated one of said two polarizations, a desired slant angle for the antenna is achieved.

10 Claims, 10 Drawing Sheets

Figures 1, 1A:
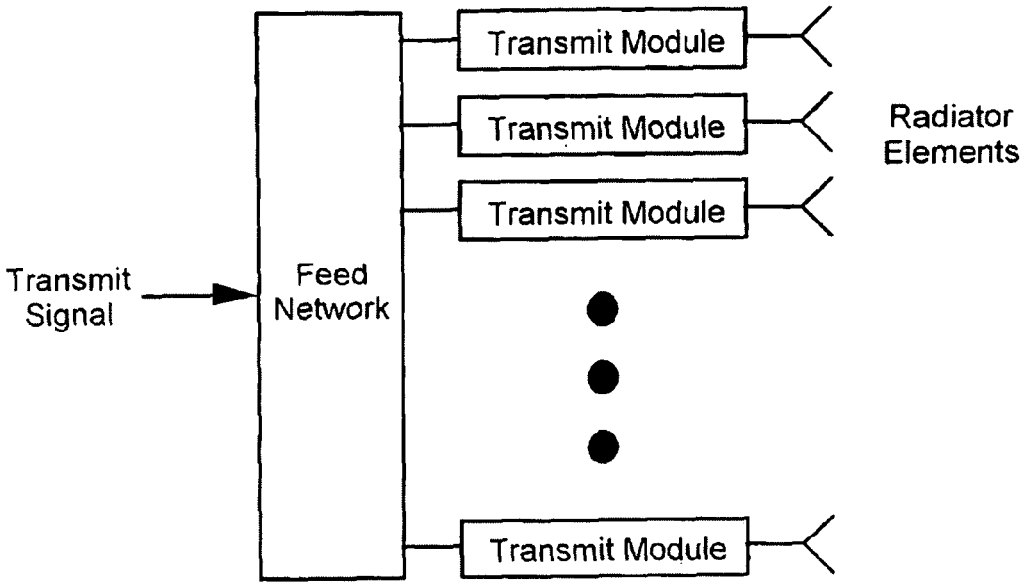
Figure 1-1a (Prior Art)

Switched-polarization transmit module.

Background: Transmit-receive active phased array (e.g., for a radar application)

Dual-polarization transmit module
capable of providing any polarization state.

Dual-polarization receive module
capable of providing any polarization state.

Switched-polarization transmit module.

Alternate implementation of a switched-polarization transmit module providing termination of the unused polarization.

Switched-polarization receive module

Alternate implementation of a switched-polarization receive module providing termination of the unused polarization.

Example of a switched-polarization transmit-receive module.

Element population mix for a linear polarization slant angle of 0 degrees.
(All elements are horizontally polarized.)

Example of an element population mix for a linear polarization slant angle of 22.5 degrees. (White = Horizontally polarized elements; Black = Vertically polarized elements)

Example of an element population mix for a linear polarization slant angle of 45 degrees. (White = Horizontally polarized elements; Black = Vertically polarized elements)

Example of an element population mix for a linear polarization slant angle of 67.5 degrees. (White = Horizontally polarized elements; Black = Vertically polarized elements)

Element population mix for a linear polarization slant angle of 90 degrees. (All elements are vertically polarized.)

DEVICE AND METHOD FOR POLARIZATION CONTROL FOR A PHASED ARRAY ANTENNA

FIELD OF THE INVENTION

This application claims the benefit of U.S. Provisional Application Ser. No. 60/727,051 filed on Oct. 14, 2005, which is incorporated herein by reference. The present invention relates generally to antennas. More particularly, it relates to an apparatus and method for control of the polarization of a phased array antenna which dynamically allocates the individual polarization of radiator elements between individual horizontal and vertical polarization modes, to control the overall polarization of the radiated signal of the antenna.

BACKGROUND OF THE INVENTION

Geostationary Communication Satellites

Satellite communications utilizes electromagnetic waves to carry information from the ground to space and back. An electromagnetic wave consists of an electric field and a magnetic field that are perpendicular to each other and to the direction of propagation. Polarization is a term that defines the orientation of the electric field as the wave propagates through space. It can be manipulated into two commonly employed types of polarization: Linear (e.g. vertical, horizontal and slanted) and Circular (Right-Hand and Left-Hand) polarizations.

An important application of polarization of the signals broadcast is in frequency reuse. Polarization of the broadcasts of two electromagnetic waves, one traveling in the vertical plane and the other in the horizontal plane, allows both broadcasts to use the same frequency without unduly impacting one another. This provides the ability to essentially double capacity of frequencies available for use.

The term earth station is the internationally accepted term that includes satellite communications stations located on the ground. They can be configured and utilized in a number of ways, but in order for an earth station to transmit or receive a signal, it will require uplink and/or downlink equipment. At both ends of the communication link between the earth station and the satellite, an antenna linked to a transponder provides both the means to transmit the radio frequency (RF) signal to the satellite and to receive a signal from the satellite. Ideally, antennas for this purpose help to minimize Radio Frequency interference (RFI) by using reflectors to focus the RF signal onto a single satellite.

Commercial geostationary communication satellites typically employ linearly polarized signals; however, some also employ circular polarization. The transponder polarization is defined at the satellite with a "horizontally" polarized signal having its E-field oriented parallel with the equatorial plane and a "vertically" polarized signal having its E-field oriented perpendicular to the equatorial plane (or parallel to the Earth's rotational axis).

Since a geostationary satellite in general may not be at the same longitude as an Earth station, the polarization of the satellite signals as viewed from the Earth station will usually not correspond to horizontal and vertical in local Earth station coordinates. If the satellite longitude is far to the east or west of the Earth station, the signal polarization as viewed at the Earth station may differ substantially from the nominal polarization defined at the satellite. This difference may approach 90 degrees when the satellite is near the horizon and the Earth station is at a low latitude. Since the available satellites are stationed at different longitudes, the apparent polarization slant angle will vary from satellite to satellite.

As noted, to achieve maximum spectral usage of the limited spectrum available, completely independent signals are transmitted and received by the satellites on orthogonal polarizations, typically designated "horizontal" (H) and "vertical" (V), on the same frequency. This practice of transmission or reception of independent signals on the two polarizations is called "frequency reuse." Since frequency reuse provides a substantial economic benefit, it has become the standard for nearly all geostationary commercial communication satellites. However, frequency reuse requires that the earth station polarization be accurately aligned with the satellite polarization. More importantly, it also requires the earth station to have excellent rejection of the undesired polarization on both the uplink (transmit) and downlink (receive) sides of the communication link to prevent interference to or from other users of the same satellite. For this reason, Earth stations must provide a capability for adjusting their transmit and receive polarizations to closely match those of the satellites with which they communicate.

Conventional Earth stations employ reflector ("dish") antennas which typically use a circular feed horn with an orthomode coupler or "transducer" (OMT) to implement the two orthogonal linear polarizations (for transmit and receive). The feed horn is mechanically rotated to precisely match its polarizations with those of the satellite signals. The circular feed horn/OMT is a relatively simple device that has little impact on the overall design of the reflector antenna.

In future satellite communication applications it may be desirable to replace the reflector antenna with a phased array. Phased array antennas employ a plurality of "radiator" elements and their associated active electronics to form a beam for transmission or reception. The beam is pointed or scanned electronically by means of phase control devices associated with each radiator element. Thus, a phased array can provide beam pointing and/or scanning without the use of moving parts. Sidelobes are typically controlled by means of amplitude weighting applied through amplitude control devices associated with each radiator element. A phased array can therefore provide more flexibility and capability in controlling sidelobes than a reflector antenna. These principles are well-known and well-documented in the literature, e.g., Mailloux (1994) and Hansen (1998).

The beam pointing and sidelobe control functions require control of the phase and amplitude of the RF signals passing through each radiator element (radiator) in the phased array. (The term "radiator" as employed herein is used for both receive elements and transmit elements). The active electronic circuits associated with each radiator element are often collectively referred to as a "channel" or a "module" (e.g., transmit module, receive module, T-R module) although these electronic circuits may physically be grouped together into larger assemblies. FIGS. 1-1*a* through 1-1*c* show typical overall array architectures for transmit (TX), receive (RX) and transmit-receive (T-R) phased arrays, respectively.

Polarization in phased array antennas must be controlled at the element level and ideally should be fully electronic. This makes the problem of polarization control in phased arrays more complex than the above noted case of polarization control in reflector antennas. One approach used in the prior art involves a dual-polarized radiating element driven by separately-controlled excitation signals for the two orthogonal polarizations. By adjusting the amplitude and phase differences between the two excitations any polarization state may be achieved. Completely independent amplitude and phase control for the two polarizations also facilitates measurement and correction of errors, a process known as calibration.

Limitations of the Prior Art

As FIGS. 1-2*a* and 1-2*b* indicate, implementing full polarization agility in a transmit or receive module essentially doubles the number of active components required with respect to the number in a single-polarization module. This has a very significant impact on the array cost and power consumption/dissipation per element. It may also increase the difficulty of implementation at high microwave frequencies where the space for components behind each radiator element is limited.

It would be desirable to implement a polarization control scheme which introduces a minimal amount of additional complexity above that required for a single-polarization phased array. Such an approach would not only reduce the RF parts count per element but would also simplify the digital control system since approximately half the number of command bits per element would be required. The disclosed approach to polarization control enables the element-level electronics to be simplified from two signal paths or "channels" in the prior art (as in FIGS. 1-2) to a single channel as shown in FIGS. 2-1 through 2-3. This has a number of benefits, which are objects of this invention including:

1. Significantly reduced cost of the element-level electronics due to the reduced parts count while retaining full polarization control in the main beam.
2. Reduced space/volume required by the element-level electronics, permitting polarization control in arrays at high microwave frequencies where close element spacing may not permit the use of two channels per element.
3. Reduced power consumption.
4. Reduced thermal dissipation.
5. Simpler control interface circuit configuration.
6. Reduced throughput requirements in the control interface.
7. Reduced throughput requirements in the beam steering controller.
8. Smaller calibration tables.

Another object of this invention is to provide an improved method for control of polarization of a phased array antenna.

An additional object of this invention is the provision of a method for configuring a phased array antenna for angle and polarization which employs a novel polarization assignment algorithm.

Another object of this invention is the provision of such a control scheme for polarization of a phased array antenna which introduces a minimal amount of additional complexity above that required for a single-polarization phased array.

An additional object of this invention is the provision of such a control scheme for polarization of a phased array antenna which minimizes the cost and complexity of implementation.

Yet another object of this invention is to provide a method of dynamically allocating the individual polarization of radiator elements between their individual horizontal and vertical polarization modes, to yield the desired slant angle for a phased array antenna.

With respect to the above description, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other devices, methods, steps, and systems for carrying out the several purposes of the present invention. It is important, therefore, that the objects and claims be regarded as including such equivalent construction and methodology insofar as they do not depart from the spirit and scope of the present invention.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE ASSOCIATED DRAWINGS

FIGS. 1-1*a* through 1-1*c* show typical prior art overall array architectures for transmit (TX), receive (RX) and transmit-receive (T-R) phased arrays, respectively.

FIGS. 1-2*a* and 1-2*b* show functional block diagrams of transmit and receive modules using a prior art dual-channel-per-element approach.

Figures 1, 1B:
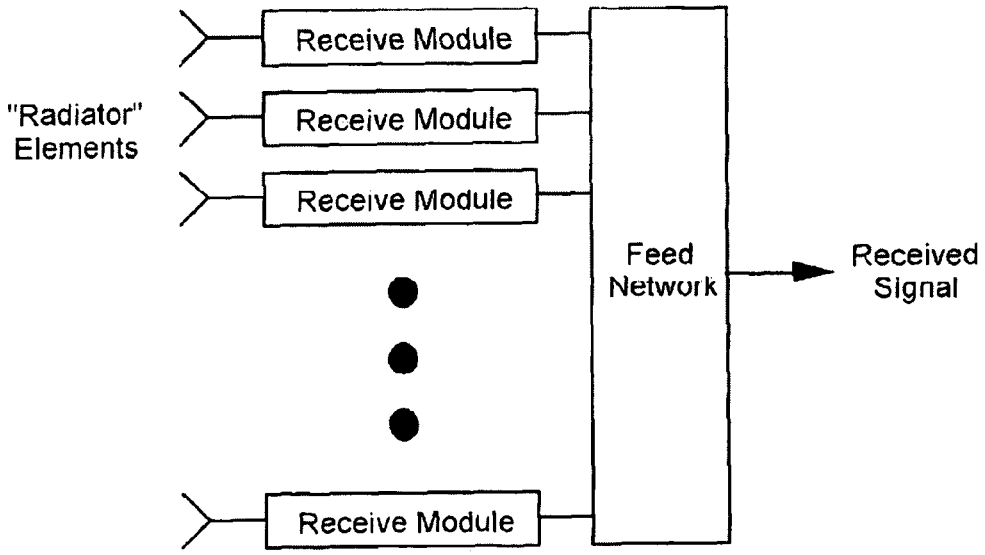
Figure 1-1b (Prior Art)
Figures 1, 1C:
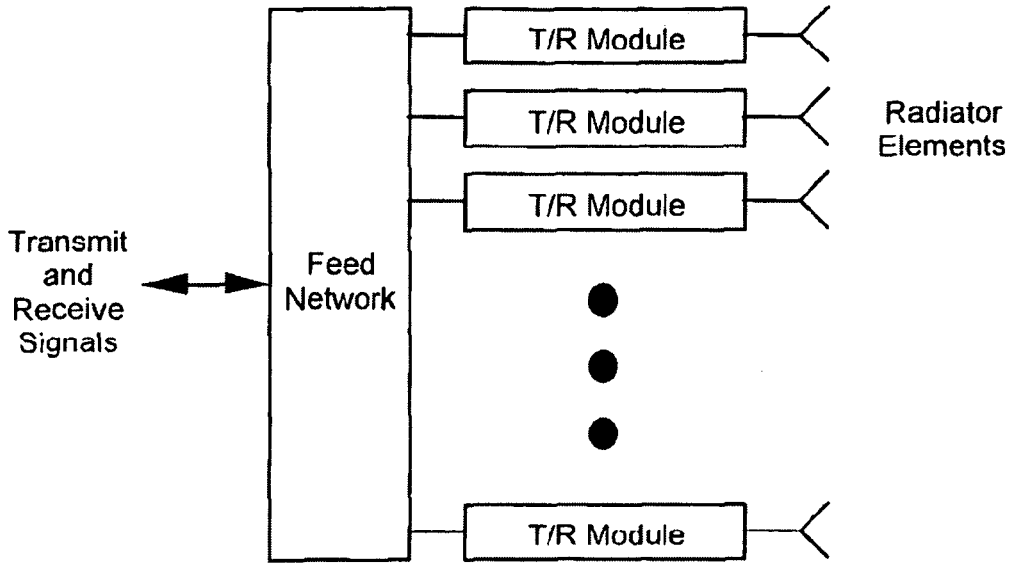
Figure 1-1c (Prior Art)
Figures 1, 2, 2A:
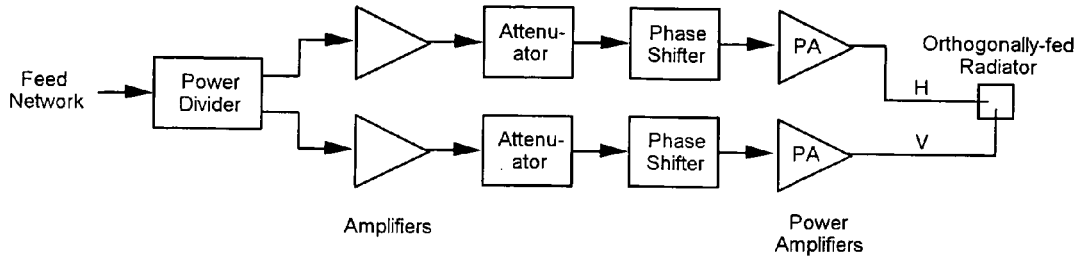
Figure 1-2a. Prior art:
Figures 1A, 2:
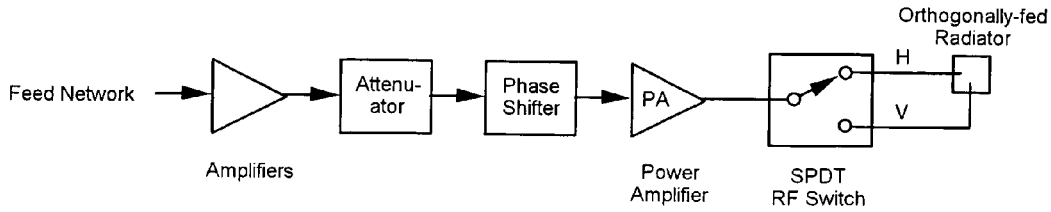
Figures 1B, 2:
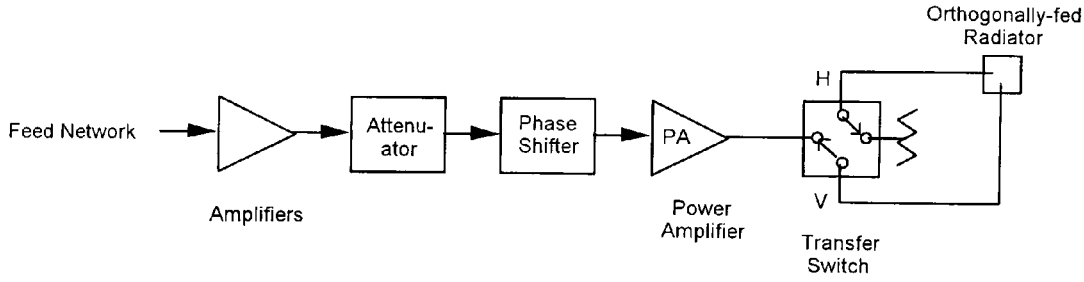
Figures 2, 2A:
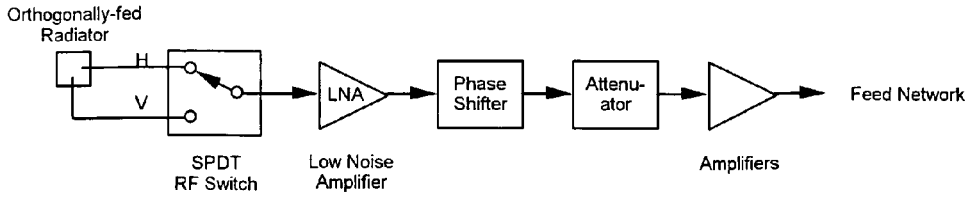
Figures 2, 2B:
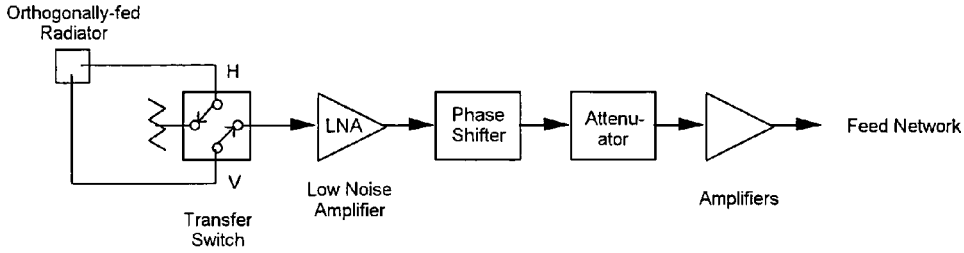
Figures 2, 3:
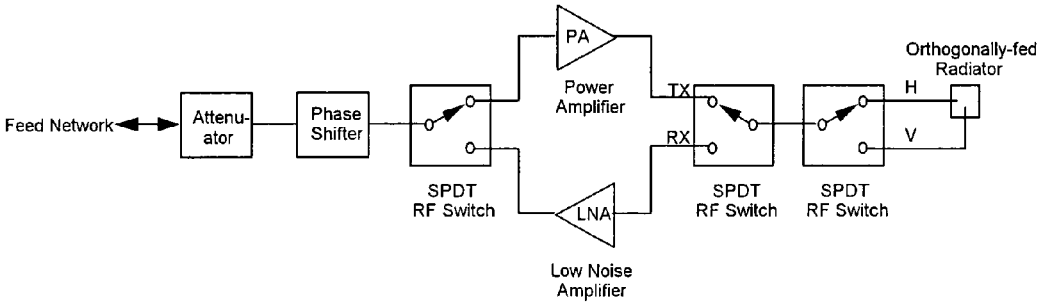
Figures 2, 3, 4, 4A:
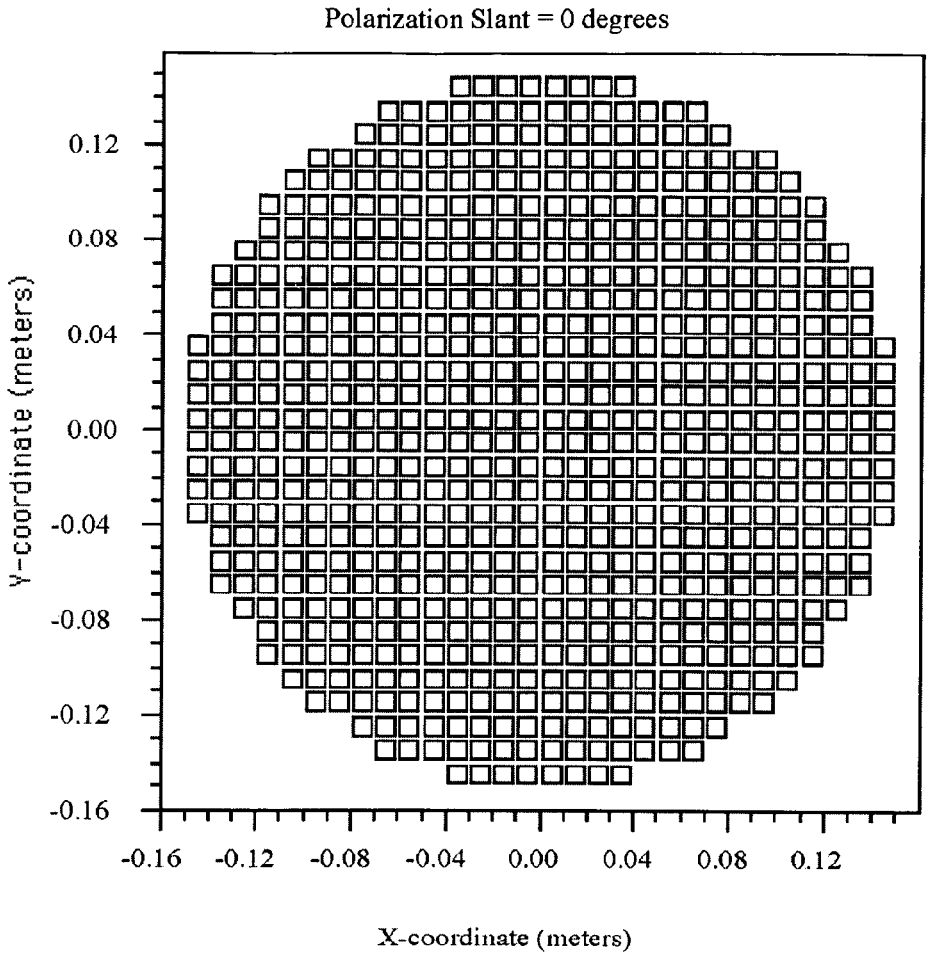
Figures 2, 3, 4, 4B:
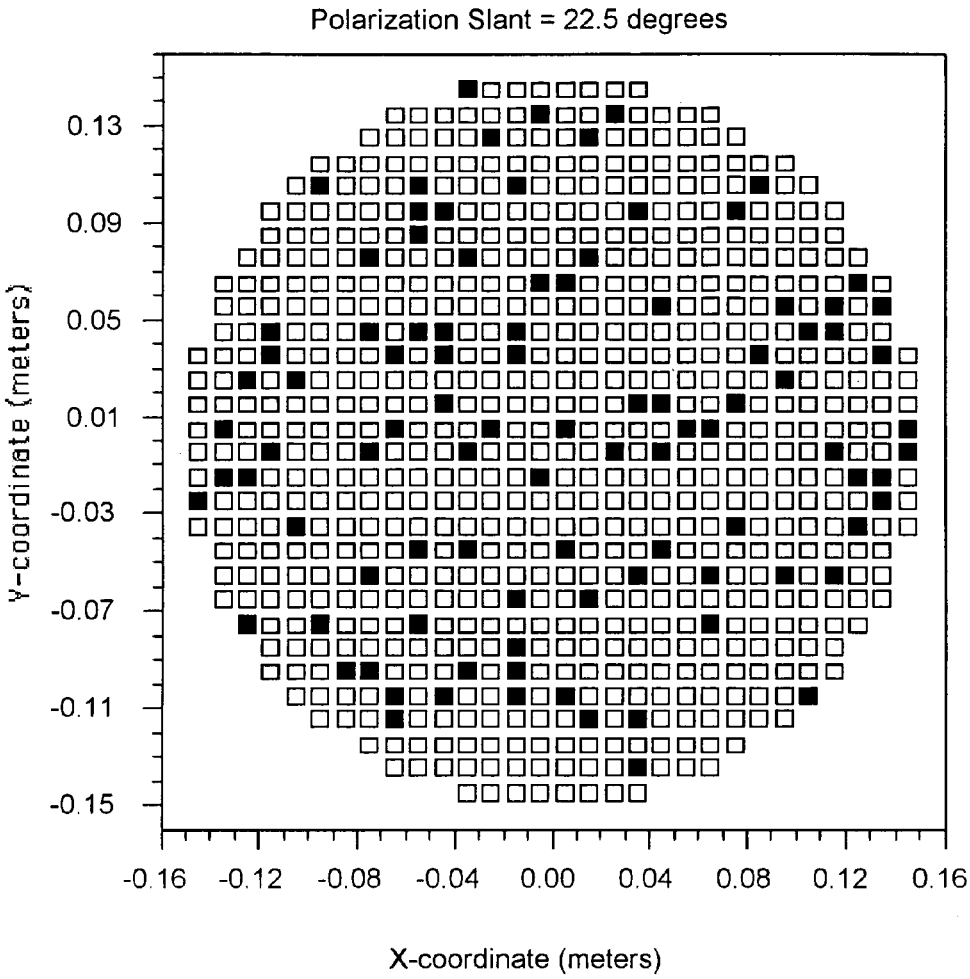
Figures 2, 3, 4, 4C:
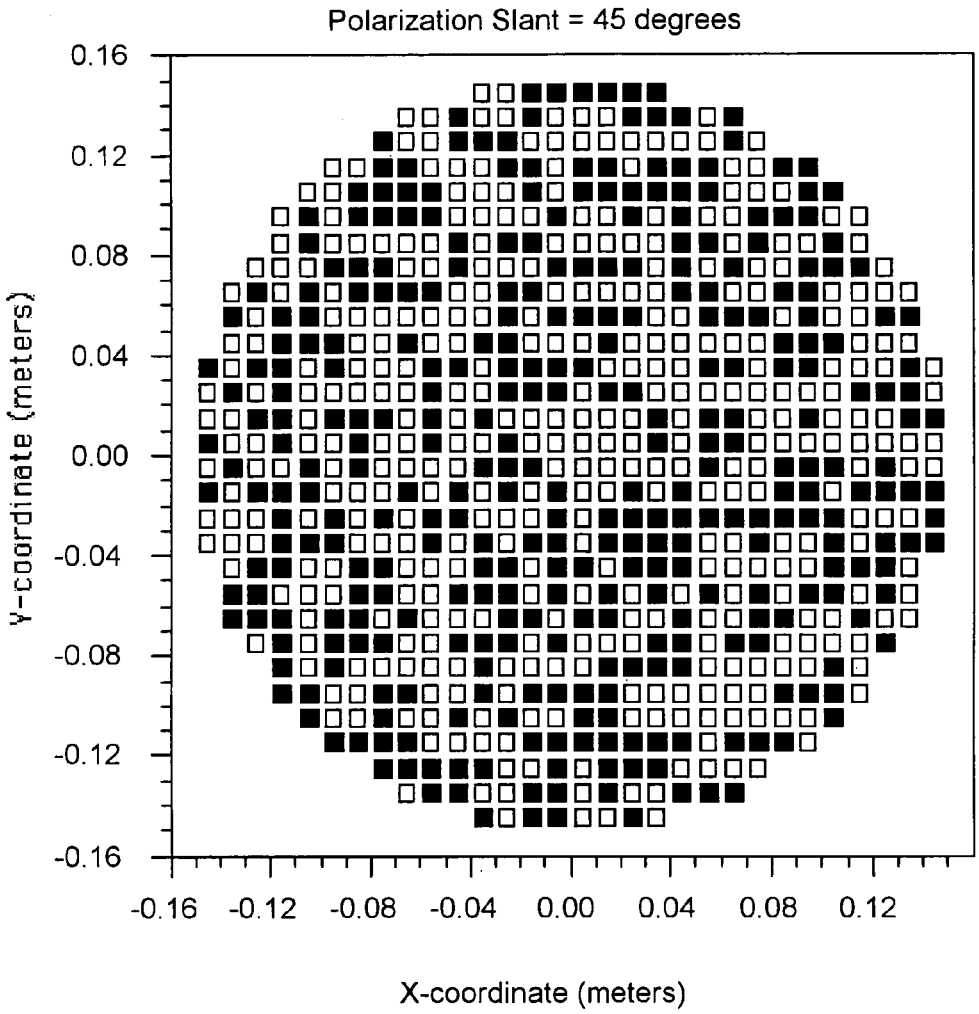
Figures 2, 3, 4, 4D:
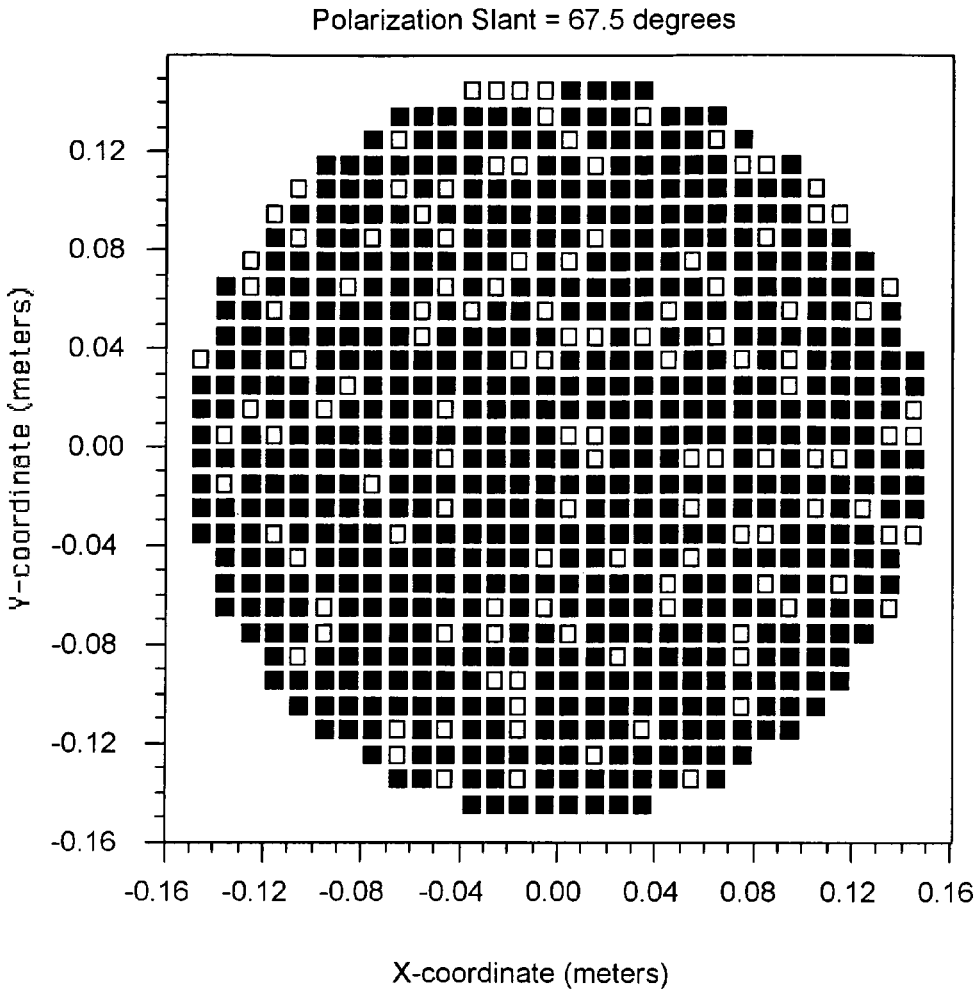
Figures 2, 3, 4, 4E:
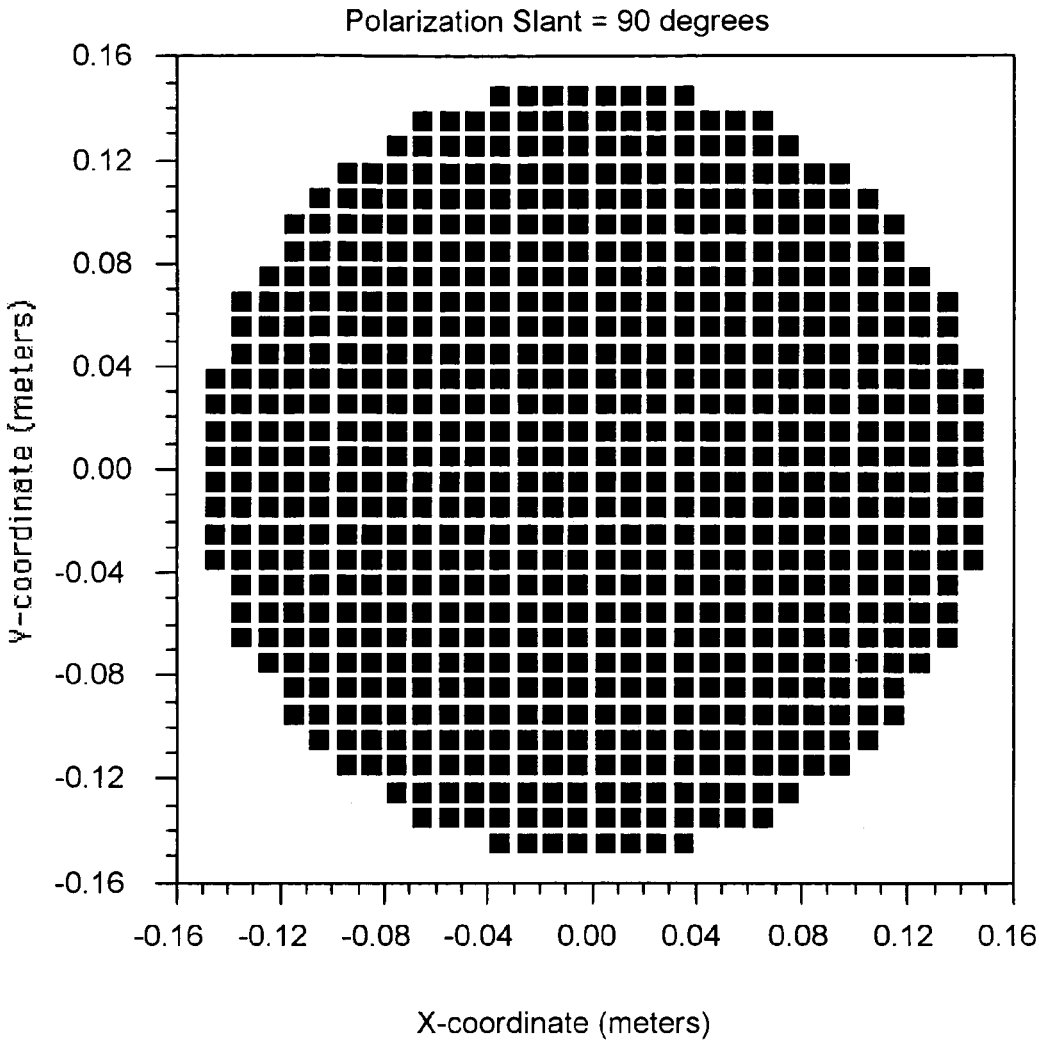

FIG. 2-1*a* and 2-1*b* show functional block diagrams of switched-polarization transmit modules.

Figures 1, 2, 2B:
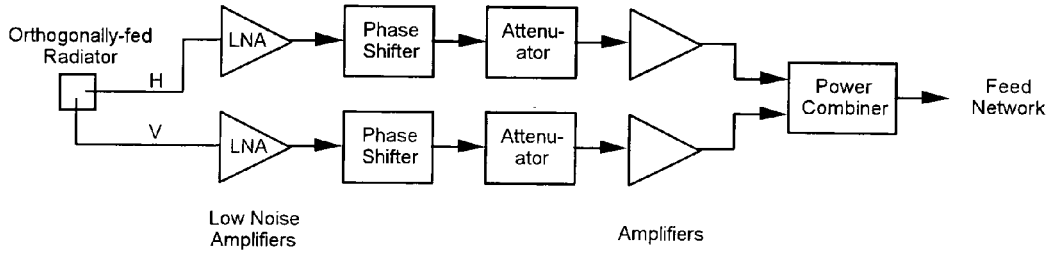
Figure 1-2b. Prior art:

FIGS. 2-2*a* and 2-2*b* show corresponding functional block diagrams for switched-polarization receive modules.

FIGS. 2-3 shows an example of a functional block diagram of a switched-polarization transmit-receive (T-R) module.

FIGS. 2-4*a* depicts an example of a phased array antenna configured using the method herein wherein the antenna element population mix is configured for a linear polarization slant angle of 0 degrees wherein all elements are horizontally polarized.

FIGS. 2-4*b* show an example of an element population mix for a linear polarization slant angle of 22.5 degrees wherein the elements outlined in black with white interiors depict horizontally polarized elements and those in solid black depict vertically polarized elements.

FIGS. 2-4*c* depicts an example of a phased array antenna with an element population mix for a linear polarization slant angle of 45 degrees wherein the elements outlined in black with white interiors depict horizontally polarized elements and those in solid black show vertically polarized elements.

FIGS. 2-4*d* shows an example of a phased array antenna configured with an element population mix for a linear polarization slant angle of 67.5 degrees wherein the elements outlined in black with white interiors depict horizontally polarized elements and those in solid black depict vertically polarized elements.

FIGS. 2-4*e* depicts an example of a phased array antenna configured using the disclosed method herein wherein all elements are depicted in solid black and showing an element population mix for a linear polarization slant angle of 90 degrees wherein all elements are vertically polarized.

DETAILED DESCRIPTION OF PREFERRED EMBODIMENTS OF THE DISCLOSED DEVICE

Referring now to the drawings in figures, some preferred embodiments of the present invention in current preferred modes in accordance with the present invention are shown. However, the drawings depicted should in no fashion be considered as limiting the device and method and any and all changes or other embodiments that would occur to those skilled in the art are considered within the scope of this invention.

As noted the disclosed method and apparatus relates to the control of the polarization of phased array antennas as applicable in the fields of satellite communication, terrestrial line-of-sight communication and radar. The method herein disclosed provides a method of controlling the polarization of a phased array antenna in which each radiator element radiates or receives signals in one of two orthogonal, switch-selected polarizations (e.g., horizontal or vertical) by controlling the individual switches of each element to place each element in the desired polarization. The ratio of horizontal to vertical elements in the array determines the slant angle of the composite linear polarization in free space. Individual elements can be assigned polarizations using a probabilistic polarization assignment algorithm which generates a pseudo-random mix of horizontally and vertically polarized elements with the desired ratio. A phase difference can be introduced between the populations of horizontally and vertically polarized elements to obtain circular polarization or any desired degree of ellipticity.

The disclosed method and apparatus thus employs a simplified element-level polarization switching method to implement array-level polarization control. Switching means controlling the polarization of individual elements are switched to operate the individual elements in either of two orthogonal polarizations (e.g., "horizontal" or "vertical" in the array's coordinate system). The resulting mixture of elements operating in H and V polarizations is then used to form a composite polarization in the main beam in free space with the resulting slant angle of the linear polarization being determined by the relative proportions of the H and V elements in the array. The disclosed approach provides full polarization control at the array level while using a simple, single-channel module design.

FIGS. 2-1 shows functional block diagrams of switched-polarization transmit modules, while FIGS. 2-2 shows corresponding functional block diagrams for switched-polarization receive modules. FIGS. 2-3 shows an example of a functional block diagram of a switched-polarization transmit-receive (T-R) module. Those skilled in the art will realize that there are other functionally-equivalent ways to configure these modules so FIGS. 2-1 through 2-3 are presented only as examples to illustrate the principle of polarization switching and any functionally-equivalent manner to configure the modules as would occur to those skilled in the art is anticipated within the scope of this patent.

A key aspect of this invention is the use of an algorithm to set the ratio of the populations of orthogonally polarized elements to obtain the desired linear polarization slant angle in the main beam. The preferred embodiment of the polarization assignment algorithm is probabilistic although a deterministic algorithm may also be used.

The description of the polarization control algorithm that follows will be in terms of its application to a transmit array. Through the principle of reciprocity which is well known in the antenna art this discussion also applies to receive arrays.

Consider a dual-polarized radiator element having two feed ports, each of which excites an orthogonal polarization component such as horizontal (H) or vertical (V) polarization. Examples of such radiators include, but are not limited to, crossed dipoles, orthogonally fed square waveguides and dual-polarized microstrip patches. When such a radiator element is used in a transmit array, the sinusoidal RF signal feeding the horizontally polarized radiator port can be expressed as:

$$a_{w(i)}a_{h(i)}\cos(\omega_c t+\phi_i)$$

where $a_{w(i)}$=weighting amplitude of the excitation at the ith radiator element (proportional to the excitation current). The $a_{w(i)}$ coefficient values are typically assigned by a weighting function for the purpose of controlling sidelobes.

$a_{h(i)}$=enabling coefficient for the horizontally polarized excitation component at the ith radiator element (=0 or 1). The $a_{h(i)}$ coefficient values are set by a polarization assignment algorithm, an example of which will be described below.

$\omega_c$=radian frequency of the RF carrier t=time $\phi_i$=relative phase of the excitation at the ith radiator element. The $\phi_i$ values are typically set by a beam steering and/or shaping algorithm.

Similarly, the signal feeding the vertically polarized radiator port can be written as:

$$a_{w(i)}a_{v(i)}\cos(\omega_c t+\phi_i+\delta\phi_v)$$

where $a_{v(i)}$=enabling coefficient for the vertically polarized excitation component at the ith radiator element (=0 or 1). The $a_{v(i)}$ coefficient values are set by a polarization assignment algorithm, an example of which will be described below.

$\delta\phi_v$=phase difference term applied to the excitations of all radiator elements assigned to operate in vertical polarization.

The coefficients $a_{h(i)}$ and $a_{v(i)}$ are mutually exclusive. That is, if $a_{h(i)}=1$ then $a_{v(i)}=0$, and vice versa. In logical notation $$a_{v(i)}=\overline{a_{h(i)}}$$

where the over-bar represents the logical "not". The phase difference term $\delta\phi_v$ is zero for linear polarization. For circular polarization $\delta\phi_v$ is set to either +90 or −90 degrees depending on the desired rotational sense. These points will be elaborated below.

Linear Polarization with Arbitrary Slant Angle. Let the desired polarization slant angle be designated $\psi_s$ with a value of zero representing horizontal polarization and a value of $\pi/2$ (or 90 degrees) representing vertical polarization. The fraction of radiators to be excited in the horizontally polarized mode is $$F_h=\cos^2\psi_s$$

while the fraction of radiators to be excited in the vertically polarized mode is $$F_v=1-F_h$$

$$=\sin^2\psi_s$$

Let u represent a uniformly distributed random variable whose value can range between 0 and 1. For each radiator element i a new value of u is generated. The polarization assignment algorithm is applied at each radiating element using the polarization switch as follows:

if $u_i<F_h$ then

Polarization Switch is set to "Horizontal":

$(a_{h(i)}=1;\ a_{v(i)}=0)$ otherwise

Polarization Switch is set to "Vertical":

$(a_{h(i)}=0;\ a_{v(i)}=1)$

The $a_{h(i)}$ and/or $a_{v(i)}$ enabling coefficients are effectively applied multiplicatively with the amplitude weighting coefficient $a_{w(i)}$ required for sidelobe control.

Although the preferred embodiment described above uses a pseudo-random algorithm to assign a polarization state to each radiator element, a deterministic algorithm may also be used provided that the desired ratio between the orthogonally polarized (e.g., H and V) radiator populations is obtained. Any polarization assignment algorithm must also maintain, to the greatest extent possible, other desirable characteristics of the antenna such as pattern shape and sidelobes.

Circular Polarization. Circular polarization (CP) can be obtained by introducing a 90 degree phase difference($\delta\phi_v$) between the excitation phases of the populations of horizontally and vertically polarized radiators. This phase difference can be added to the phase commands required to steer the beam. When $\delta\phi_v=-90$ degrees (that is, the radiators' vertical excitations lag the horizontal excitations by 90 degrees) the radiated wave will be right-hand circularly polarized (RHCP) [Stutzman and Thiele, 1981]. If $\delta\phi_v=+90$ degrees (that is, the radiators' vertical excitations lead the horizontal excitations by 90 degrees) the radiated wave will be left-hand circularly polarized (LHCP). The phase difference term $\delta\phi_v$ can be added to the phase term used for steering the beam with the net required phase shift being applied through the existing phase shifters in the transmit and receive channels.

The phase difference term $\delta\phi_v$ as defined above is only added to the excitation of the radiator elements assigned to vertical polarization (i.e., those for which $a_{v(i)}=1$). Equivalent implementations could add phase terms to the horizontally polarized radiator excitations or to excitations for both polarizations, provided that the desired phase difference between the two polarizations is maintained. Obtaining circular polarization requires coordination between the RF switch commands and the excitation phase commands.

If necessitated by a particular phase shifter design a phase difference value of $\delta\phi_v=-270$ degrees may be substituted for a value of +90 degrees. In the present context phase difference values of +90 degrees and −270 degrees are considered to be equivalent, as are phase difference values of −90 degrees and +270 degrees.

A circularly polarized beam pointed normally from the array (zero scan in azimuth and elevation) would require equal numbers of horizontally and vertically polarized elements that are excited 90 degrees but of phase. When the beam is scanned away from broadside the population ratio of H and V radiator elements may need to be adjusted to maintain a good polarization circularity or axial ratio, particularly if there are differences between the element patterns for the two polarizations. This technique can also be used to compensate for errors from other sources that might affect the axial ratio.

Note that the claims of this invention are not intended to apply to the mere use of a switched-polarization radiator, which exists in the prior art. Rather, the focus of the invention is the on use of element-level polarization switching in conjunction with a polarization assignment algorithm to adjust the population ratio of the orthogonally polarized sets of radiators in order to obtain the desired polarization in the far field.

The foregoing discussion has assumed that the radiator elements can be excited to radiate (or receive) linearly polarized wave components whose polarization orientations are orthogonal (i.e., at right angles to one another). These polarization components have been designated "horizontal" (H) and "vertical" (V) for convenience although those designations are completely arbitrary. When there is no phase difference between the populations of H and V excited elements the slant orientation of the composite linearly polarized wave is determined by the relative numbers of horizontally and vertically excited elements. Circular polarization can be produced by introducing a 90 degree phase difference between the populations of horizontally and vertically polarized elements when those populations are equal. The circularity or axial ratio can be varied by varying the relative numbers of H and V elements when a 90 degree phase difference is present. It should now be evident to persons skilled in the art that the radiator elements could alternatively be designed to radiate (or receive) circularly polarized orthogonal wave components. These wave components can be designated "right-hand circular polarization" (RHCP) and "left-hand circular polarization" (LHCP), and these two excitation modes are mathematically orthogonal. When there is no phase difference between the populations of RHCP and LHCP excited elements the circularity or axial ratio can be varied by varying the relative numbers of RHCP and LHCP elements. The composite polarization can range from pure RHCP (when all elements are RHCP) through linear (when half of the elements are RHCP and half are LHCP) to pure LHCP (when all elements are LHCP). The slant orientation of the linear polarization obtained when equal numbers of RHCP and LHCP elements are excited can be controlled by varying the phase difference between the populations of RHCP and LHCP excited radiators. Thus, although much of the preceding discussion has assumed the use of linearly polarized (H/V) excited radiators, the principles of this invention apply equally well when the radiators are designed to be excited in circularly polarized (RHCP/LHCP) modes.

The figures in the drawings of FIG. 2 show implementations of the device are achieved using the method and polarization assignment algorithm herein described. FIG. 2-1*a* and 1*b* depict embodiments of the device and method using an implementation of a switched-polarization transmit module providing termination of the unused polarization. Of course other configurations are possible such as changes in the order of stages, additional amplifiers, etc. and all such changes which would occur to those skilled in the art are anticipated within the scope of this patent.

FIGS. 2-4*a* through 2-4*e* show examples of the radiator polarization mix for linear polarization slant angles of 0 degrees (horizontal), 22.5, 45, 67.5 and 90 degrees (vertical), respectively. Of course, these are merely examples of an infinite number of possible element configurations that could be generated employing the disclosed probabilistic algorithm for polarization assignment and component configurations depending upon the desired slant angle and polarization for the intended task. Also, this polarization control method is not restricted to circular arrays but can be applied to a phased array of any shape.

Although the method and apparatus element-level polarization switching of a phased array in conjunction with a probabilistic algorithm as disclosed and described herein discloses steps in a process, arrangements of elements of particular construction and configurations, for illustrating preferred embodiments of the structure and method of operation of the present invention, it is to be understood that elements of different construction and configuration and other arrangements thereof, other than those illustrated and described, may be employed in accordance with the spirit of this invention. Any and all such changes, alternations and modifications as would occur to those skilled in the art are considered to be within the scope of this invention as broadly defined in the appended claims.

Further, the purpose of the included abstract of the invention, is to enable the U.S. Patent and Trademark Office and the public generally, and especially the scientists, engineers, and practitioners in the art who are not familiar with patent or legal terms or phraseology to determine quickly from a cursory inspection the nature and essence of the technical disclosure of the application. The abstract is neither intended to define the invention of the application, which is measured by the claims, nor is it intended to be limiting, as to the scope of the invention in any way.

What is claimed is:

1. A method of controlling the polarization of a phased array antenna having a plurality of individual radiator elements, each of which is capable of radiating and receiving signals in one of two orthogonal, switch-selected polarizations, to yield a desired polarization in said antenna with any desired slant angle, comprising the steps of:

determining a desired polarization slant angle for said phased array antenna for communication with an orbiting satellite from a terrestrial location;

employing a polarization assignment algorithm to calculate a population ratio of said plurality of radiator elements between two orthogonal polarizations to ascertain a determined polarization state, from said two orthogonal polarizations, for each said plurality of radiator elements, to achieve said population ratio; and switching each respective said radiator element, to said determined polarization state, to yield said population ratio, whereby the desired slant angle is achieved in said phased array antenna.

2. The method of controlling the polarization of a phased array antenna of claim 1 additionally comprising the steps of: employing a deterministic algorithm as said polarization assignment algorithm.

3. The method of controlling the polarization of a phased array antenna of claim 2 additionally comprising the steps of: employing a data processor with computer software adapted to run said polarization assignment algorithm; and communicating to a respective means for switching each individual radiator element to one of said two orthogonal, polarizations, the determined polarization state said respective element, to cause each member of said plurality of radiator elements to assume said determined polarization state.

4. The method of controlling the polarization of a phased array antenna of claim 1 additionally comprising the steps of: employing a probabilistic algorithm as said polarization assignment algorithm.

5. The method of controlling the polarization of a phased array antenna of claim 4 additionally comprising the steps of: employing a data processor with computer software adapted to run said polarization assignment algorithm; and communicating to a respective means for switching each individual radiator element to one of said two orthogonal, polarizations, the determined polarization state said respective element, to cause each member of said plurality of radiator elements to assume said determined polarization state.

6. The method of controlling the polarization of a phased array antenna of claim 1 additionally comprising the steps of: employing a data processor with computer software adapted to run said polarization assignment algorithm; and communicating to a respective means for switching each individual radiator element to one of said two orthogonal, polarizations, the determined polarization state said respective element, to cause each member of said plurality of radiator elements to assume said determined polarization state.

7. The method of claim 6 wherein said the polarization assignment algorithm employed to calculate said desired switching mode to yield said desired one of said two polarizations, for each said respective radiator element, is determined by the equation:

where an RF signal exciting a horizontal radiator port can be expressed using magnitude and phase as $$a_{w(i)}a_{h(i)}\cos(\omega_c t+\phi_i);\text{ and}$$

where the signal exciting a vertical port is written as $$a_{w(i)}a_{v(i)}\cos(\omega_c t+\phi_i+\delta\phi_v)\text{ and;}$$

where $\omega_c$ is the radian frequency of the RF carrier; and where the desired polarization is slant-linear the phase difference $\delta\phi_v$ can be ignored; and where the desired polarization slant angle can be designated $\psi_s$, where a value of zero represents horizontal polarization and a value of $\pi/2$ (or 90 degrees) represents vertical polarization; and where the fraction of radiators to be excited in the horizontally polarized mode is $F_h=\cos^2\psi_s$; and the fraction to be excited in the vertically polarized mode is $F_v=1-F_h=\sin^2\psi_s$; and where U represents a uniformly distributed random variable having values ranging between 0 and 1; and for each radiator element i a new value of u is generated;

employing a polarization assignment algorithm to switch polarization between horizontal and vertical for each radiator element at the element level, employing the polarization switch as follows:

$$\text{if } u_i<F_h$$

$$(a_{h(i)}=1;\ a_{v(i)}=0)$$

polarization switch set to horizontal, otherwise $$(a_{h(i)}=0;\ a_{v(i)}=1)$$

polarization switch set to vertical, wherein the $a_{h(i)}$ and $a_{v(i)}$ weights discussed above are effectively applied multiplicatively with other amplitude weighting function(s) required for sidelobe control.

8. The method of controlling the polarization of a phased array antenna of claim 6 additionally comprising the steps of: employing a commanded phase difference between populations of orthogonally polarized radiator elements to generate circular or elliptical polarization.

9. The method of claim 1 wherein said the polarization assignment algorithm employed to calculate said desired switching mode to yield said desired one of said two polarizations, for each said respective radiator element, is determined by the equation:

where an RF signal exciting a horizontal radiator port can be expressed using magnitude and phase as $$a_{w(i)}a_{h(i)}\cos(\omega_c t+\phi_i);\text{ and}$$

where the signal exciting a vertical port is written as $$a_{w(i)}a_{v(i)}\cos(\omega_c t+\phi_i+\delta\phi_v)\text{ and;}$$

where $\omega_c$ is the radian frequency of the RF carrier; and where the desired polarization is slant-linear the phase difference $\delta\phi_v$ can be ignored; and where the desired polarization slant angle can be designated $\psi_s$, where a value of zero represents horizontal polarization and a value of $\pi/2$ (or 90 degrees) represents vertical polarization; and where the fraction of radiators to be excited in the horizontally polarized mode is $F_h=\cos^2 \psi_s$; and the fraction to be excited in the vertically polarized mode is $F_v=1-F_h=\sin^2 \psi_s$; and where u represents a uniformly distributed random variable having values ranging between 0 and 1; and for each radiator element i a new value of u is generated;

employing a polarization assignment algorithm to switch polarization between horizontal and vertical for each radiator element at the element level, employing the polarization switch as follows:

if $u_i<F_h$ $(a_{h(i)}=1;\ a_{v(i)}=0)$ polarization switch set to horizontal, otherwise $(a_{h(i)}=0;\ a_{v(i)}=1)$ polarization switch set to vertical, wherein $a_{h(i)}$ and $a_{v(i)}$ weights discussed above are effectively applied multiplicatively with other amplitude weighting function(s) required for sidelobe control.

10. The method of controlling the polarization of a phased array antenna of claim 1 additionally comprising the steps of: employing a commanded phase difference between populations of orthogonally polarized radiator elements to generate circular or elliptical polarization.

* * * * *